United States Patent [19]

Westermark

[11] 4,386,670

[45] Jun. 7, 1983

[54] BORING HEAD WITH EXTENSION ELEMENTS

[75] Inventor: Gustav L. Westermark, Årsunda, Sweden

[73] Assignee: Santrade Ltd., Lucerne, Switzerland

[21] Appl. No.: 256,972

[22] Filed: Apr. 23, 1981

[30] Foreign Application Priority Data

May 27, 1980 [SE] Sweden ..... 8003905

[51] Int. Cl.[3] ..... E21B 10/20

[52] U.S. Cl. ..... 175/344; 299/80; 407/41; 407/49

[58] Field of Search ..... 175/344, 53, 346, 347, 175/406, 412, 413, 342, 382, 384; 299/79, 80, 93; 403/263, 361, 374; 407/41, 49, 94, 95

[56] References Cited

U.S. PATENT DOCUMENTS

| | | | |
|---|---|---|---|
| 1,332,745 | 3/1920 | Bakes | 299/93 |
| 3,318,392 | 5/1967 | Hoen | 299/93 |
| 4,108,259 | 8/1978 | Dixon et al. | 175/344 |
| 4,142,598 | 3/1979 | Maxsted | 175/384 X |

*Primary Examiner*—Ernest R. Purser
*Assistant Examiner*—Michael Starinsky
*Attorney, Agent, or Firm*—Burns, Doane, Swecker & Mathis

[57] ABSTRACT

A boring head for reaming a pre-drilled hole in raise boring or for similar earth cutting operations comprising a plurality of roller cutters (13–22). For purposes of extending the radius of the boring head (10) in operation or decreasing its dimensions during transport one or several extension elements (36, 37) are provided for detachable attachment to the boring head (10) by means of a wedge connection (42).

12 Claims, 3 Drawing Figures

BORING HEAD WITH EXTENSION ELEMENTS

This invention relates to a boring head for rotary boring of the face of earth formations comprising a plurality of roller cutters which are rotatably carried by mounting means. The boring head can be extended radially by means of an extension element which is detachably attachable to the boring head and carries at least one roller cutter.

The invention relates generally to earth boring, but is particularly intended for raise boring. In raise boring a pilot hole is drilled between a lower level and an upper level in a mine, whereupon the pilot hole is enlarged by means of a reaming head having a large diameter.

In underground drilling of this type it is frequently difficult or even impossible to transport a boring head of sufficient size through existing tunnels and drifts. Since it is not justifiable for economical reasons to enlarge these tunnels and drifts merely for making possible such transport it has been proposed to employ a smaller boring head, which is readily transportable through a constricted tunnel, and enlarge the head by coupling one or several detachable extension elements thereto, when the boring head is at its work site. During the coupling operation, as a rule, a limited space is available. It is an object of the invention to simplify the coupling operation as far as possible.

Another object of the invention is to provide a coupling between the boring head and the extension element in which the stresses on the bolts therein are small and in which the risk for deformation of the extension element to occur is small.

Although the advantages of the invention are particularly great at work sites where the space is limited, it is to be understood that the invention is generally applicable for purposes of obtaining different diameters of the boring head and, at large diameters, for purposes of obtaining suitable proportions, from a weight and transportation point of view, of the parts incorporated in the overall boring head.

The above and other objects of the invention are attained by giving the invention the characterizing features stated in the appending claims.

The invention is described in detail below with reference to the accompanying drawings in which one embodiment of the invention is shown by way of example. It is to be understood that this embodiment is only illustrative of the invention and that various modifications thereof may be made within the scope of the claims.

Figure 1:
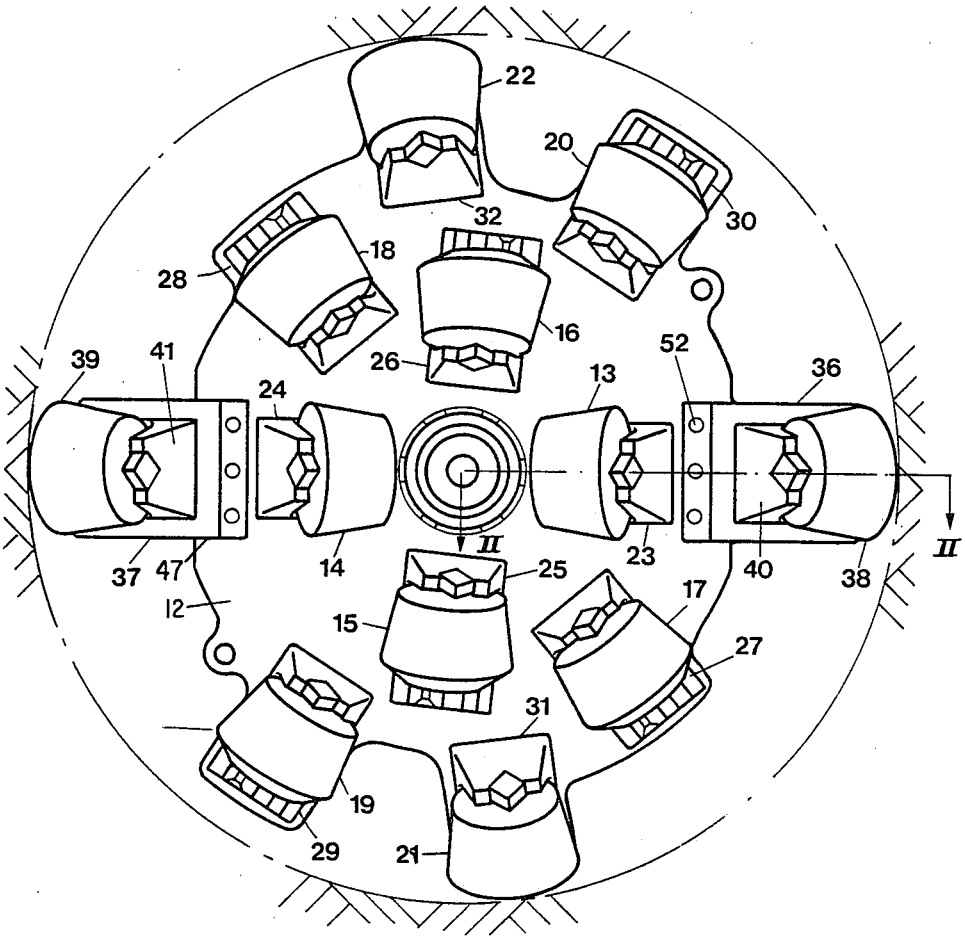
FIG. 1 is a plan view of a boring head according to the invention.
Figure 2:
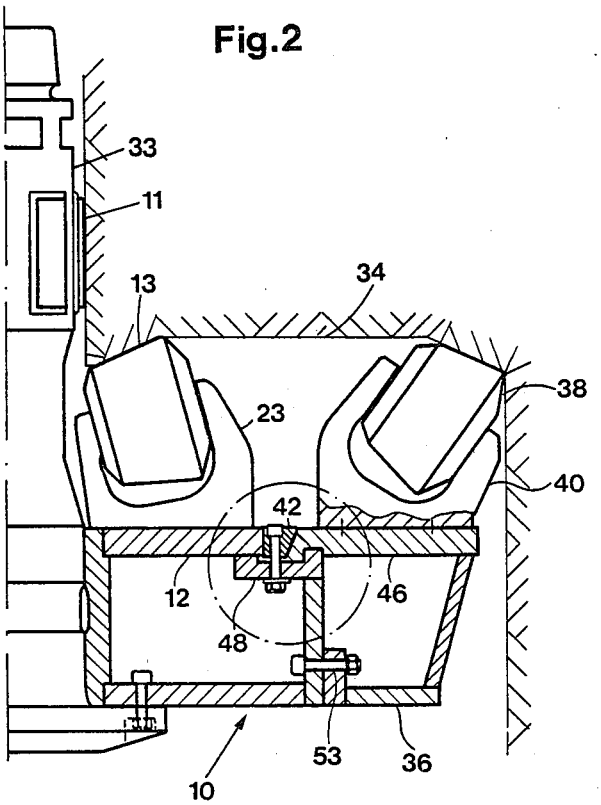
FIG. 2 is a vertical section of the boring head in FIG. 1 taken on the line II—II.
Figure 3:
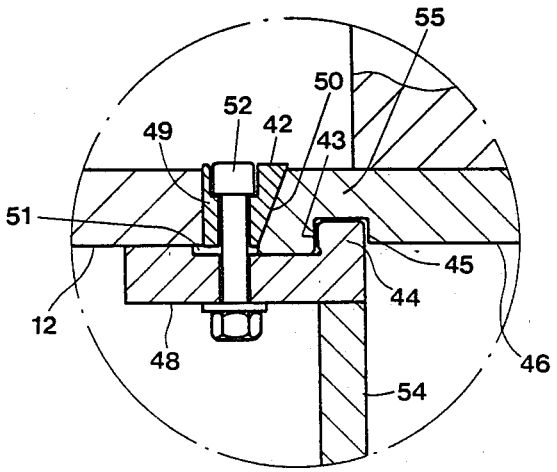
FIG. 3 shows in section on an enlarged scale the encircled portion in FIG. 2.

In the drawings, a pilot hole 11 pre-drilled in conventional manner between an upper level and a lower level, not shown, in a mine is reamed by means of a boring head generally depicted by the reference numeral 10. The boring head 10 comprises a rotary carrier plate 12 on which a plurality of roller cutters, in the illustrated embodiment ten cutters 13–22, are mounted in mounting means or saddles 23–32. A rotary drive stem 33 is attached to the boring head 10. The boring head is rotated and forced against an annular surface 34 surrounding the pilot hole 11 by means of the stem 33.

The saddles 23–32 are mounted in pairs on each side of the rotational axis 35 of the boring head and at the same distance from the axis 35. In a manner known per se, as disclosed in Swedish Pat. No. 79 00922-1, the shafts of the roller cutters 13–22 are at different angles to the rotational axis 35 in such a way that a generally convex cutting surface 34 is produced.

The dimension of the boring head 10 can be decreased during transport by disassembling two radially opposed extension elements 36, 37. The extension elements 36, 37 are then connected to the main body of the boring head at the work site. Each extension element 36, 37 carries a roller cutter, respectively 38 and 39, which are mounted in saddles 40, 41. According to the invention the extension element 36 is forced radially outwards, by means of a wedge member 42, against an abutting surface 43 on the boring head during securing of the extension element to the boring head. The abutting surface 43 is provided on an axially directed projection 44 on the boring head 10 and adapted to engage in a groove 45, which is provided on the underside of a supporting plate 46, which carries the roller cutter 38.

As shown in FIG. 1 the extension element 36 is mounted in a peripheral recess 47 in the plate 12. The projection 44 is provided on a connection member 48 in form of a L-shaped beam, which is welded to the plate 12. The projection 44 forms substantially an axial extension of the axially outer wall 54 of the boring head.

According to the invention the two opposed wedge surfaces 49, 50 of the wedge member 42 converge toward the connection member 48. In the preferred embodiment the angle between the wedge surfaces is 20°. Preferably, this angle should be large enough to avoid self-locking action, i.e. larger than about 16°.

A recess 51 is provided in the top surface of the connection member 48 at a portion thereof which radially extends across the underside of the wedge member 42. Due to the recess 51 the wedge member can, when needed in case it gets stuck, be loosened by means of a tool which is inserted into the recess.

The wedge member 42 is secured in clamped position by means of bolts 52 which extend through the wedge member as well as the connection member 48. The extension element 36 is further secured against swinging about the projection 44 by means of radially directed bolts 53, which are located behind the projection 44 when seen in the drilling direction.

The extension element 36 is mounted on the boring head 10 by first being hung on the projection 44, in which position it is retained without applying the wedge member 42 due to the fact that an axially lower portion of the extension element 36 abuts the boring head. Then the wedge member 42 is inserted between the plate 12 and the supporting plate 46 and clamped by means of the bolts 52, whereupon the bolts 53 are tightened.

According to the invention the occurence of bending stresses in the bolts 52, 53 is almost completely avoided, which means that the risk for breakage thereof is small. Preferably, the angle between the wedge surfaces 49, 50 of the wedge member should be large enough to generate an axially directed force on the radially inner tongue-shaped portion 55 of the supporting plate 46 large enough to prevent bending of this portion. The cooperating members on the boring head 10 and the extension element 36 are dimensioned such that the top surfaces of the plates 12, 46 are substantially coplanar.

In the illustrated embodiment the projection 44 is located on the boring head 10. It is believed that alternatively the projection can be located on the extension element 36, in which case the groove 45 should be provided in the boring head, more precisely in the upper surface of the plate 12.

Within the inventive concept the boring head can of course be provided with an arbitrarily large number of attachable extension elements, each of which carrying one or several roller cutters. The number of rows of cutting means on the roller cutters can vary, it is especially possible to use a single disk-type cutting means. In the illustrated embodiment the overall working radius of the boring head remains unchanged when the two extension elements are disassembled. However, it is to be understood that the invention could be used for varying the working radius by having all the outer roller cutters detachably mounted on extension elements.

I claim:

1. A boring head for rotary boring of the face of earth formations comprising:

a rotary carrier including an abutment, and a first surface which faces generally radially outwardly, a plurality of roller cutters, mounting means for mounting said roller cutters on said rotary carrier, an extension element for extending the boring head radially, said extension element carrying a roller cutter and including a second surface facing generally radially inwardly, and wedge means engaging said first and second surfaces for forcing said extension element radially outwardly against said abutment, said at least one roller cutter being located such that forces imposed on said extension element during a boring operation are so directed as to urge said extension element against said abutment.

2. A boring head according to claim 1, wherein one of said carrier and extension element includes an axially directed projection engaging within a groove of the other of said support and extension element, said abutment being defined by whichever of said projection and groove is disposed on said carrier.

3. A boring head according to claim 2, wherein said carrier includes a plate, a connection member mounted to an underside of said plate, said projection being disposed on said connection member and defining said abutment, said extension member including a support plate, said groove disposed in an underside of said support plate.

4. A boring head according to claim 3, wherein said wedge means includes opposing wedge surfaces which converge toward said connection member.

5. A boring head according to claim 4, wherein said connection member includes a top surface having a recess disposed under said wedge means.

6. A boring head according to claim 3 including at least one bolt extending through said wedge means and said connection member for forcing said wedge means against said first and second surfaces.

7. A boring head according to claim 3 including at least one radially directed fastener for connecting said extension to said carrier, said fastener being disposed behind said projection relative to the direction of advancement of the boring head for preventing said extension from swinging about said projection.

8. A boring head according to claim 2, wherein said rotary carrier includes an outer circumferential wall, said projection comprising an axial extension of said outer circumferential wall.

9. An extension element adapted to be mounted on a rotary carrier of a boring head to extend the boring head radially, said extension element comprising:

at least one roller cutter, a supporting plate carrying said roller cutter, said supporting plate being connectible to the rotary carrier and including:

a generally radially inwardly facing side surface which is inclined relative to vertical to define a wedge surface arranged to be acted upon by a wedge for forcing said supporting plate radially outwardly, and an abutting surface which faces generally radially outwardly and is arranged to engage an abutment of the rotary carrier as said supporting surface is wedge radially outwardly.

10. An extension element according to claim 9, wherein said supporting surface includes a groove in an underside thereof, said groove extending generally parallel to said side surface and arranged to receive the abutment of the rotary carrier such that a side wall of said groove defines said abutting surface.

11. An extension element according to claim 9, wherein said side surface slopes radially outwardly in the drilling direction.

12. An extension element for extending a boring head radially comprising a supporting plate which carries at least one roller cutter, said supporting plate having a radially inward side surface, said side surface sloping radially outwards in the drilling direction for providing a wedge surface, a groove being provided in the bottom surface of the supporting plate, said groove extending generally parallel to the side surface.

* * * * *